United States Patent [19]

Olevitch

[11] Patent Number: 5,044,129

[45] Date of Patent: Sep. 3, 1991

[54] CRYOGENIC MECHANICAL MEANS OF PAINT REMOVAL

[75] Inventor: Albert Olevitch, Englewood, Ohio

[73] Assignee: The United States of America as represented by the Secretary of the Air Force, Washington, D.C.

[21] Appl. No.: 548,398

[22] Filed: Jul. 5, 1990

[51] Int. Cl.[5] ..... B24C 1/00

[52] U.S. Cl. ..... 51/322; 51/319; 51/321; 51/410

[58] Field of Search ..... 51/320, 321, 322, 410, 51/292, 326, 319

[56] References Cited

U.S. PATENT DOCUMENTS

| | | | |
|---|---|---|---|
| 3,130,083 | 4/1964 | Turner . | |
| 3,468,077 | 10/1966 | Jones et al. | 51/314 |
| 3,934,379 | 1/1976 | Braton | 51/322 |
| 4,312,156 | 1/1982 | McWhorter | 51/418 |
| 4,355,488 | 10/1982 | Schmitz et al. | 51/319 |
| 4,491,484 | 1/1985 | Williams | 134/4 |
| 4,524,548 | 6/1985 | Klee et al. | 51/322 |
| 4,554,025 | 11/1985 | Burke et al. | 134/17 |
| 4,627,197 | 12/1986 | Klee et al. | 51/322 |
| 4,631,250 | 12/1986 | Hayashi | 430/329 |
| 4,646,484 | 3/1987 | Brull | 51/322 |
| 4,655,847 | 4/1987 | Ichinoseki | 51/320 |
| 4,693,756 | 9/1987 | Schlich | 51/322 |
| 4,731,125 | 3/1988 | Carr | 134/17 |
| 4,836,858 | 6/1989 | Reinhart | 134/1 |
| 4,924,643 | 5/1990 | Buiguez | 51/322 |

FOREIGN PATENT DOCUMENTS

| | | | |
|---|---|---|---|
| 242639 | 2/1987 | Fed. Rep. of Germany | 51/322 |
| 7117239 | 6/1972 | Netherlands | 51/322 |

*Primary Examiner*—Frederick R. Schmidt
*Assistant Examiner*—Blynn Shideler
*Attorney, Agent, or Firm*—Fredric L. Sinder; Donald J. Singer

[57] ABSTRACT

A method for cryogenic removal of paint and other surface coatings is disclosed. Alternate stream pulses of a cryogenic fluid and abrasive beads are directed at a surface coating to alternately embrittle and then shatter the coating. The pulse durations and the time intervals between pulses are generally less than one second and may be on the order of micro and milliseconds. The cryogenic stream pulses may also be alternated with other mechanical paint removal methods.

12 Claims, No Drawings

CRYOGENIC MECHANICAL MEANS OF PAINT REMOVAL

RIGHTS OF THE GOVERNMENT

The invention described herein may be manufactured and used by or for the Government of the U.S. for all governmental purposes without the payment of any royalty.

BACKGROUND OF THE INVENTION

The present invention relates generally to methods for removing paint and other protective coatings from surfaces, and more specifically to a cryogenic paint removal method.

Protective coatings, such as paint, may become worn or weathered over time and require replacement. Or, it may simply be desired to change the appearance of the coated surface. Such coatings frequently have to be first removed from the surface before replacement or other changes can be made. Prior art methods for removing paint, particularly removing paint from aircraft, present a number of difficulties. Removal is very labor intensive and often requires the use of highly active physical and chemical materials.

Traditionally, solvent-based strippers have been used for aircraft paint removal. As the technology of aircraft coatings has advanced, however, ever stronger solvents, or chemical strippers, have been required to remove, or strip, aircraft coatings from aircraft surfaces. The use of these stronger, and more active, chemical strippers present severe environmental risks. Also, the stronger chemical strippers can damage the organic component of the newer matrix composite materials increasingly being used in modern aircraft construction.

Mechanical pain removal by abrasive blasting is a newer alternative to chemical removal methods. Abrasive media, both hard and soft, such as crushed corn cobs, glass beads, plastic beads, walnut shells, synthetic diamond dust, garnet particles, dry ice (frozen carbon dioxide) pellets and, of course, sand have been tried, each with limited success.

A third pain removal method, often combined with mechanical paint removal methods, has been to either chill or heat the coating to make it more easily removed. In U.S. Pat. No. 4,627,197 to Klee et al, for example, coated articles are prechilled for a substantial period of time by, typically, directing against them a stream of cryogenic fluid for several minutes to embrittle the coating, followed by blasting with strongly abrasive particles for a time. The Klee et al patent also teaches that the amount of refrigerant needed can be reduced by warming the coated structure to a very warm temperature during the blasting operation. U.S. Pat. No. 4,836,858 to Reinhart discloses using a stream of a cooling fluid, such as carbon dioxide gas, in combination with its described reciprocal motion ultrasonic scraping tool.

Generally, the mechanical paint removal prior art has had to rely upon either hard abrasive particles, commonly called grit, or hard edged tools to work successfully, whether or not used in combination with chilling or heating. These hard edged processed can damage surfaces, especially thinner modern aircraft outer surfaces. Thus it is seen that there is a need for a method for removing coatings from surfaces that will work successfully with softer abrasive particles.

It is, therefore, a principal object of the present invention to provide a cryogenic paint removal process that will work successfully in combination with an abrasive blasting process using softer particles.

It is a feature of the present invention that it can be performed using existing parts or straightforward modifications of existing parts.

It is an advantage of the present invention that, in addition to its advantage of being able to use softer particles, the velocity of the particles can be reduced.

It is another advantage of the present invention that it can require less cryogenic fluid than other methods.

These and other objects, features and advantages of the present invention will become apparent as the description of certain representative embodiments proceeds.

SUMMARY OF THE INVENTION

The present invention provides a novel method for cryogenic paint removal. The unique discovery of the present invention is that directing against the paint rapidly alternating streams of a cryogenic fluid and abrasive particles, such as plastic beads, can remove coatings more effectively and efficiently than other cryogenic paint removal methods. By varying not only the time period of each alternate stream, but also the time period between streams, the method can be further improved.

Accordingly, the present invention is directed to a method for removing coatings from surfaces, comprising the step of directing against a coating alternately pulsed streams of a cryogenic fluid and of solid particles, wherein the duration of each pulse of each alternate stream is less than one second. The duration of each pulse of each alternate stream may also be less than one-tenth second. The time interval between each pulse of alternate streams may be less than one second or less than one-tenth second. The solid particles may be plastic beads.

The invention is also directed to a method for removing coatings from surfaces, comprising the step of alternating with the application of any mechanical coating removal method the step of directing against the coating a pulsed stream of a cryogenic fluid, wherein the duration of each pulse is less than one second. The time interval between alternately applying the mechanical removal method and each pulse of the cryogenic stream may be less than one second.

DETAILED DESCRIPTION

The method is performed using a pair of nozzles mounted either side to side or one inside the other. One nozzle is attached to a conventional apparatus for applying a blast of abrasive particles, either hard or soft. The other nozzle is attached to a conventional apparatus for supplying a stream of cryogenic fluid, which may be liquified carbon dioxide or nitrogen, or a variety of other liquified gases and other cryogenic fluids. The cryogenic fluid may also include frozen particles, such as frozen carbon dioxide.

Instead of directing both streams at a surface coating at the same time, stream pulses from each nozzle are alternated. The stream pulses should generally be less than one second and the time interval between each alternate pulse should also be less than one second. The time duration of each alternate pulse, and the time interval following each alternate pulse, may be different for the cryogenic pulse and the abrasive particle pulse.

Generally, the duration of the cryogenic pulse should be long enough to embrittle the coating so that the immediately following bead blast can then shatter the embrittled coating. Because the two streams are alternated, the chilling effect from the cryogenic stream is not reduced by the warming effect from the repeated impact of the solid particles from the bead blast. Also, the rapid temperature changes caused from the alternating pulses further contributes to a more effective destruction of the coating.

It is anticipated that pulse durations and in-between time intervals on the order of micro and milliseconds will work effectively.

Those with skill in the art of the invention will readily see that the stream pulses of cryogenic fluid may also be alternated with other mechanical coating removal methods, such as scraping (including ultrasonic scraping) with the same good effect.

The disclosed method for removing surface coatings successfully demonstrates the use of alternating pulses of a cryogenic fluid and application of a mechanical paint removal method. Although the disclosed invention is specialized, its teachings will find application in other areas where steps used in mere simultaneous combination are not as effective or as efficient as may be desired.

It is understood that modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. A method for removing coatings from surfaces, comprising the step of directing against a coating alternately pulsed streams of a cryogenic fluid and of solid particles, wherein the duration of each pulse of each alternate stream is less than one second.

2. The method for removing coatings from surfaces according to claim 1, wherein the duration of each pulse of each alternate stream is less than one-tenth second.

3. The method for removing coatings according to claim 1, wherein the time interval between each pulse of alternate streams is less than one second.

4. The method for removing coatings according to claim 3, wherein the time interval between each pulse of alternate streams is less than one-tenth second.

5. The method for removing coatings according to claim 1, wherein the solid particles are plastic beads.

6. A method for removing coatings from surfaces, comprising the step of alternating with the application of any mechanical coating removal method the step of directing against the coating a pulsed stream of a cryogenic fluid, wherein the duration of each pulse is less than one second.

7. The method for removing coatings from surfaces according to claim 6, wherein the time interval between alternately applying the mechanical removal method and each pulse of the cryogenic stream is less than one second.

8. A method for removing coatings from surfaces, comprising the step of directing against a coating three or more successive pairs of alternately pulsed streams of a cryogenic fluid and of solid particles, wherein the duration of each pulse or each alternate stream is less than one second.

9. The method for removing coatings from surfaces according to claim 8, wherein the duration of each pulse of each alternate stream is less than one-tenth second.

10. The method for removing coatings according to claim 8, wherein the time interval between each pulse of alternate streams is less than one second.

11. The method for removing coatings according to claim 10, wherein the time interval between each pulse of alternate streams is less than one-tenth second.

12. The method for removing coatings according to claim 8, wherein the solid particles are plastic beads.

* * * * *